US007587827B2

(12) United States Patent
Scheiter

(10) Patent No.: US 7,587,827 B2
(45) Date of Patent: Sep. 15, 2009

(54) AUTOMATIC SWING-AWAY KNIFE SHEATH RETAINING STRAP

(75) Inventor: Paul Alan Scheiter, St. Louis, MO (US)

(73) Assignee: Hedgehog Leatherworks LLC, St. Louis, MO (US)

( * ) Notice: Subject to any disclaimer, the term of this patent is extended or adjusted under 35 U.S.C. 154(b) by 242 days.

(21) Appl. No.: 11/481,715

(22) Filed: Jul. 6, 2006

(65) Prior Publication Data

US 2008/0006660 A1 Jan. 10, 2008

(51) Int. Cl.
*B26B 29/02* (2006.01)
*B65D 25/10* (2006.01)

(52) U.S. Cl. ..... 30/151; 224/232

(58) Field of Classification Search ..... 30/156, 30/162, 298.4, 151; 224/192, 193, 198, 232, 224/238, 243, 911; D3/228; D22/118
See application file for complete search history.

(56) References Cited

U.S. PATENT DOCUMENTS 2,859,516 A * 11/1958 McQueary ..... 30/151
2,870,947 A * 1/1959 Hendry ..... 182/221
3,307,756 A * 3/1967 Brunosson et al. ..... 224/232
3,533,540 A * 10/1970 Carinci ..... 224/232
3,958,330 A * 5/1976 Hutchens ..... 30/151
3,977,582 A * 8/1976 McMahon ..... 224/246
4,414,744 A 11/1983 Collins
4,886,197 A * 12/1989 Bowles et al. ..... 224/243
5,002,213 A 3/1991 Newton et al.
5,201,447 A 4/1993 Bumb et al.
5,388,740 A * 2/1995 Garland ..... 224/675
5,450,993 A 9/1995 Guerrero et al.
5,779,114 A * 7/1998 Owens ..... 224/193
5,794,347 A 8/1998 Serpa
6,109,496 A 8/2000 Andrew et al.
6,202,908 B1 3/2001 Groover
6,364,187 B1 4/2002 Castellano et al.
6,412,674 B1 7/2002 Lipke
6,695,704 B2 * 2/2004 Parsons ..... 463/47.2

* cited by examiner

*Primary Examiner*—Hwei-Siu C Payer
(74) *Attorney, Agent, or Firm*—Polster, Lieder, Woodruff & Lucchesi, L.C.

(57) ABSTRACT

A knife sheath is provided. In various embodiments, the knife sheath includes an automatic swing-away retention strap that includes at least one biasing device. The biasing device is adapted to automatically pivot a detachable distal end of the retention strap about a fixed proximal end of the retention strap to swing the retention strap from a fastened position to an open position.

3 Claims, 8 Drawing Sheets

AUTOMATIC SWING-AWAY KNIFE SHEATH RETAINING STRAP

FIELD OF INVENTION

The invention relates generally to knife sheaths, and more particularly, to a knife sheath retaining strap that automatically swings out of the knife blade withdrawal path when the retaining strap is unfastened.

BACKGROUND OF THE INVENTION

Generally, all outdoor, hunting and other non-collapsible or non-folding knives are stored in a suitable knife sheath when not in use. Typically, the sheaths include a retaining or closure strap that is fixedly attached at a proximal end to one side of a sheath neck. A distal end of the retaining/closure strap is detachably fastenable to an opposing side of the sheath neck. A knife is typically retained in the corresponding sheath by wrapping the retaining/closure strap around a portion of a handle of the knife and fastening the retaining/closure strap distal to the sheath neck.

To withdraw or extract the knife from the sheath, the retaining/closure strap is unfastened, thereby releasing the knife handle and allowing the knife to be withdrawn/extracted. However, although the distal end of the retaining/closure strap is unfastened, the retaining/closure strap generally dangles loosely and remains in the path of the knife blade as the knife is withdrawn/extracted from the sheath. Thus, unless the retaining/closure strap is manually held clear of the knife blade extraction path, the knife blade is subject to cutting through or damaging the retaining/closure strap as the knife is withdrawn/extracted from the sheath.

BRIEF SUMMARY OF THE INVENTION

A knife sheath is provided. In various embodiments, the knife sheath includes an automatic swing-away retention strap that includes at least one biasing device. The biasing device is adapted to automatically pivot a detachable distal end of the retention strap about a fixed proximal end of the retention strap to swing the retention strap from a fastened position to an open position.

Further areas of applicability of the present invention will become apparent from the detailed description provided hereinafter. It should be understood that the detailed description and specific examples, while indicating various preferred embodiments of the invention, are intended for purposes of illustration only and are not intended to limit the scope of the invention. Additionally, the features, functions, and advantages of the present invention can be achieved independently in various embodiments of the present inventions or may be combined in yet other embodiments.

BRIEF DESCRIPTION OF THE DRAWINGS

The present invention will become more fully understood from the detailed description and accompanying drawings, wherein.

Corresponding reference numerals indicate corresponding parts throughout the several views of drawings.

DETAILED DESCRIPTION OF THE INVENTION

The following description of the preferred embodiments is merely exemplary in nature and is in no way intended to limit the invention, its application or uses. Additionally, the advantages provided by the preferred embodiments, as described below, are exemplary in nature and not all preferred embodiments provide the same advantages or the same degree of advantages.

Figure 1:
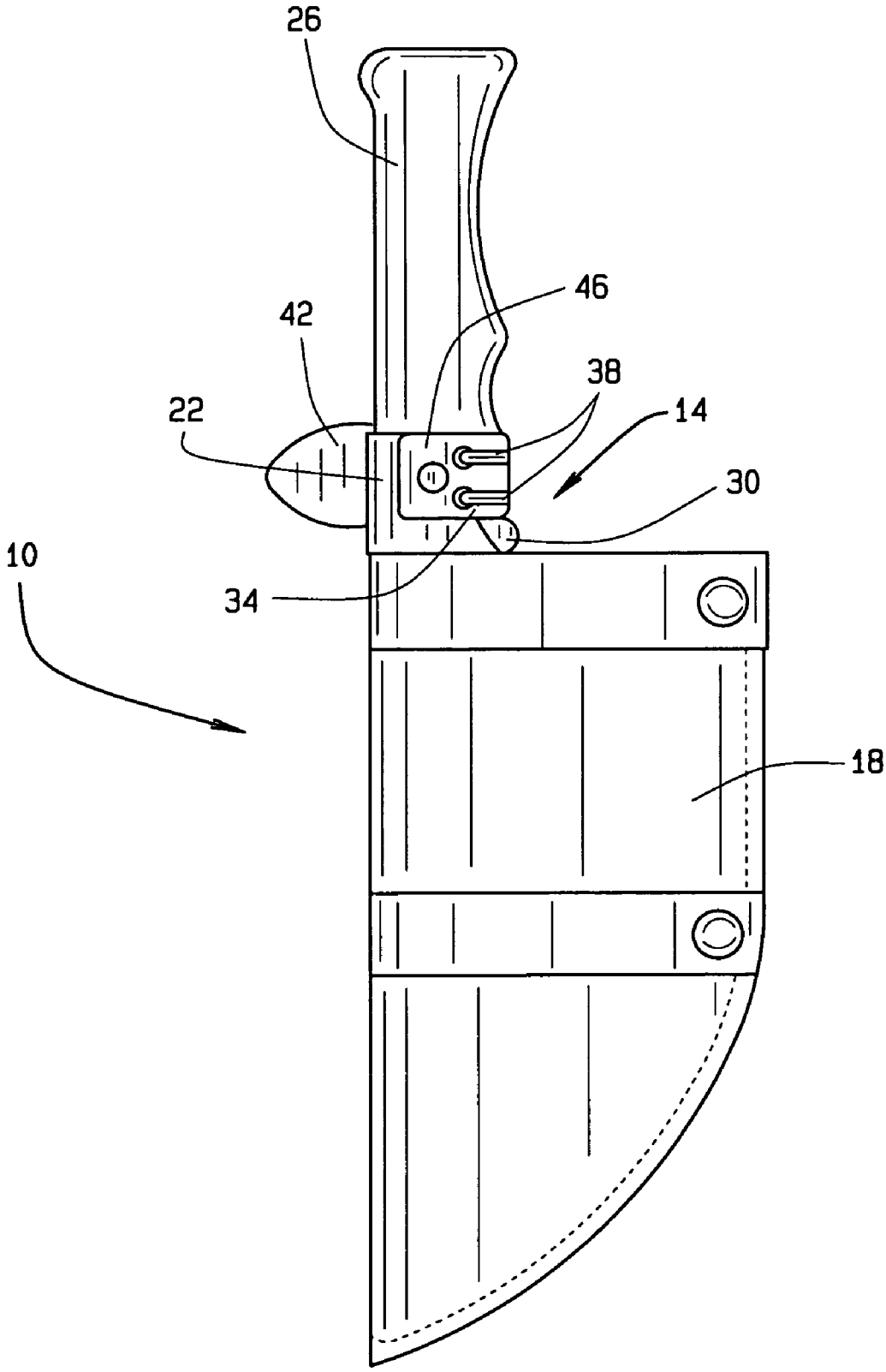
FIG. 1 is a side view of a knife sheath including an automatic swing-away retention strap, in accordance with various embodiments.
Figure 2:
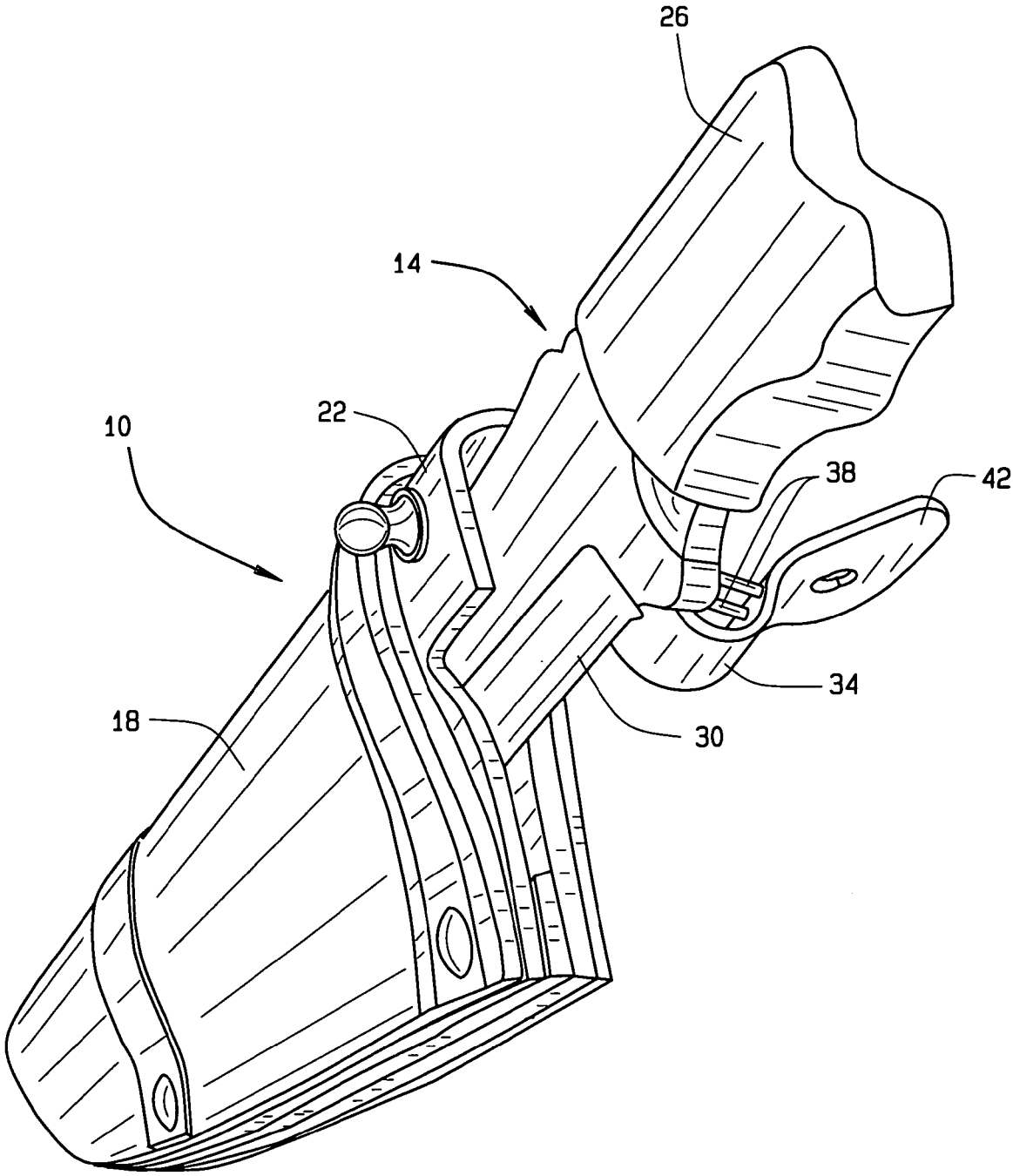
FIG. 2 is an isometric view of the knife sheath shown in FIG. 1, illustrating a knife partially removed from the sheath and the automatic swing-away retention strap in an open position, in accordance with various embodiments.

Referring to FIGS. 1 and 2, a knife sheath 10 for housing or retaining a knife 14 is illustrated. The knife sheath 10 generally includes a body portion 18 and a neck portion 22 extending from an open top of the body portion 18. The knife generally includes a handle 26 coupled with a blade 30. The sheath body portion 18 is formed to house the knife blade 30 and the neck portion 22 is formed to partially encompass a lower portion of the knife handle 26 when the knife 14 is retained within the sheath 10. In accordance with various embodiments, the sheath 10 additionally includes an automatic swing-away retention strap 34 that securely retains the knife 14 within the sheath 10 when the retention strap 34 is placed in a closed or fastened position, as illustrated in FIG. 1. The sheath 10 further includes at least one biasing or tension device 38 connected to the retention strap 34. The biasing device 38 is adapted to automatically move the retention strap 34 from the fastened position (shown in FIG. 1) to an open position (shown in FIG. 2) such that the retention strap 34 is automatically placed and held away from the open top of the body portion 18, i.e., clear of a knife blade 30 withdrawal or extraction path. Therefore, the knife 14 can be withdrawn or extracted from the sheath 10 without risk of the knife blade 30 cutting and/or damaging the retention strap 34 and without the need to manually hold the retention strap 34 clear of the knife withdrawal path.

Referring now to FIGS. 2, 3, 4 and 5, more specifically, the biasing device 38 is adapted to move the retention strap 34 from the fastened position (shown in FIGS. 4 and 5) to the open position (shown in FIGS. 2 and 3) by pivoting a distal end 42 of the retention strap about a proximal end 46 of the retention strap in an unguided, non-channeled, swing-away fashion. For example, in various embodiments, the biasing device 38 provides a force having a moment arm that will pivot the distal end 42 about the proximal end 46 such that the distal end 42 swings outwardly away from a mouth 50 of the neck portion 22 in a radial, whipping, unguided, non-channeled fashion.

The distal end 42, more particularly a distal end portion 52, is detachably connectable or fastenable to an outer surface of a first side 54 of the sheath neck 22. The distal end portion 52 can be detachably fastened to the outer surface of the neck first side 54 in any suitable manner, using any suitable fastener. For example, the distal end portion 52 can be detachably fastened to the neck first side 54 utilizing a post and loop fastener (shown throughout the various figures), a snap fastener, a button and slot fastener, hook and loop material, or any other suitable fastening device, mechanism or system. The proximal end 46, more particularly a proximal end portion 56, is fixedly attached to an outer surface of a second side 58 of the neck portion 22. The proximal end portion 56 can be fixedly attached to the neck second side 58 in any suitable manner, using any suitable fastener. For example, the proximal end portion 56 can be fixedly attached to the neck second side 58 using one or more rivets, one or more threaded cap and post connectors, or any other suitable fastening device, mechanism or system. Or, the proximal end portion 56 can be sewn to the neck second side 58.

Figure 4:
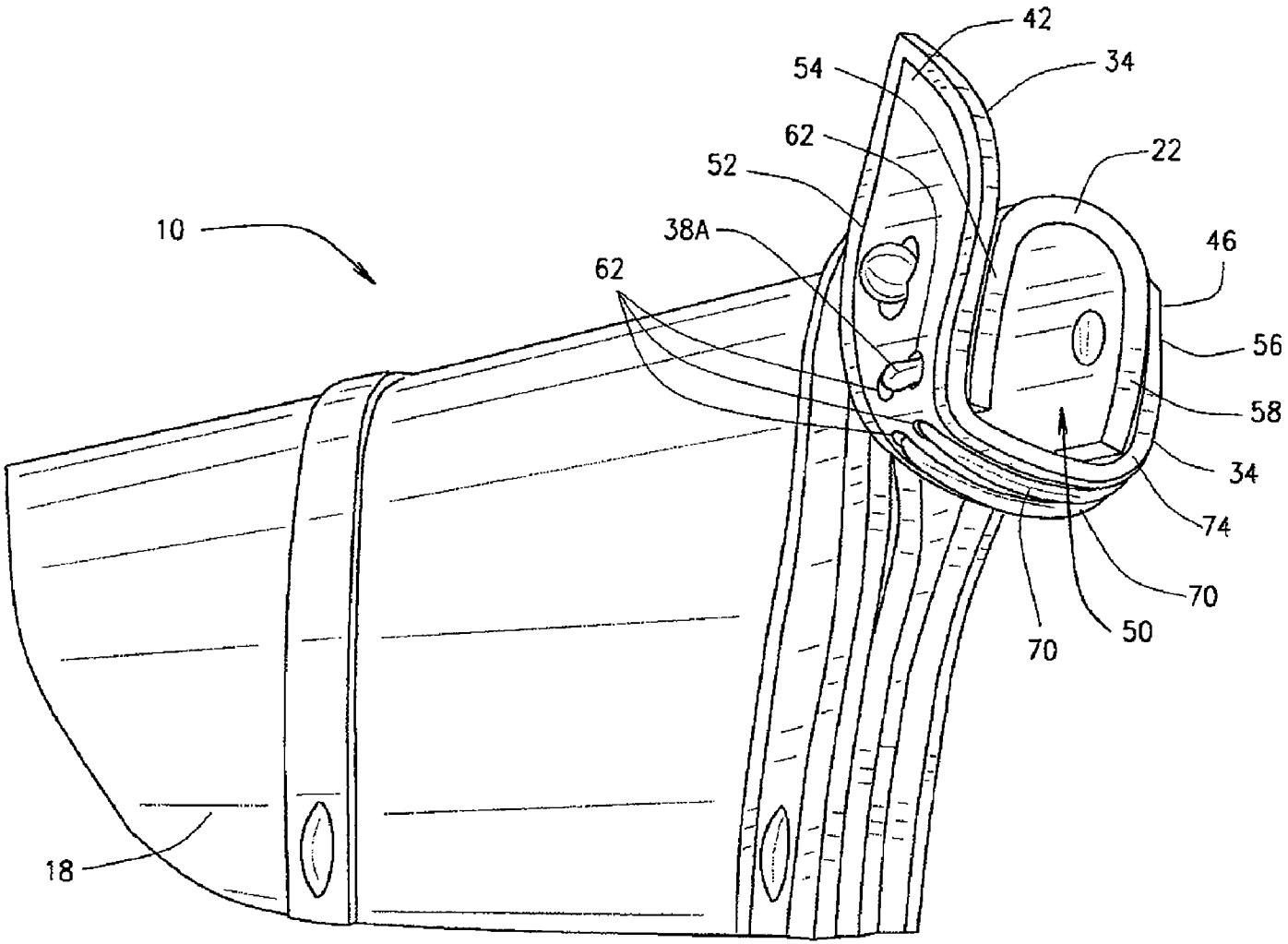
FIG. 4 is an isometric side view of the knife sheath shown in FIG. 1, illustrating the automatic swing-away retention strap in a fastened position such that the mouth of the sheath neck portion is closed.
Figure 5:
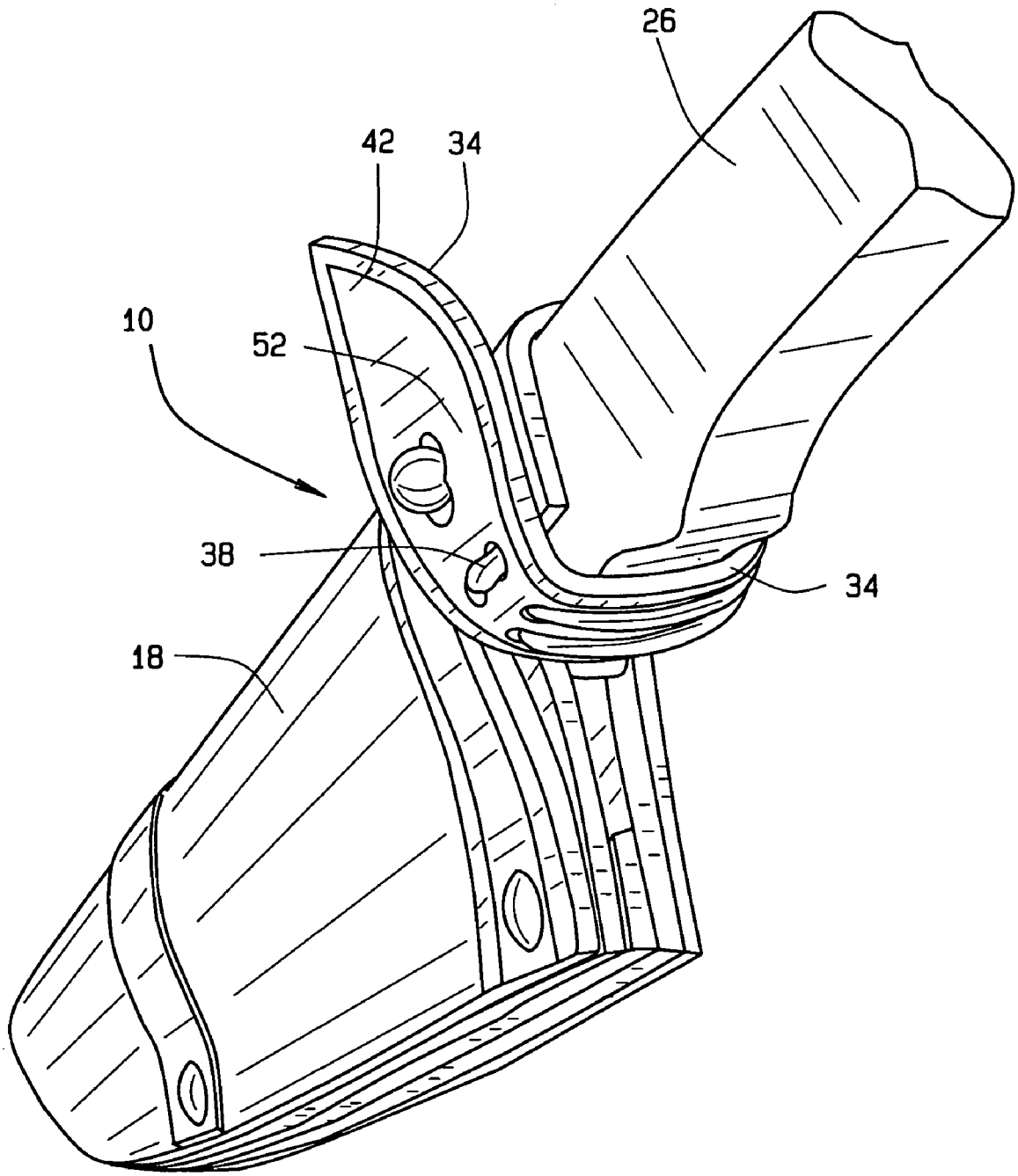
FIG. 5 is an isometric top view of the knife sheath shown in FIG. 1, illustrating the automatic swing-away retention strap in the fastened position wrapped around a portion of a handle of the knife retained within the sheath.

Referring particularly to FIGS. 4 and 5, when in the fastened position, the retention strap 34 is curved in a first direction, i.e., has a first curvature, that closes the mouth 50 of the neck 22 and effectively forms an 'O' with the neck 22. That is, if viewed from the top, when the retention strap 34 is in the fastened position, the shape of a top edge of the neck portion 22 and the shape of a top edge of the retention strap 34 having the first curvature will effectively form a closed oval-like shape or substantially a 'O' shape. Thus, when the knife 14 is placed in the sheath 10, the retention strap 34 wraps around a portion of the knife handle 26, in the first curved direction, holding the knife handle against the interior surface of the neck 22 to retain the knife 14 within the sheath 10.

Figure 3:
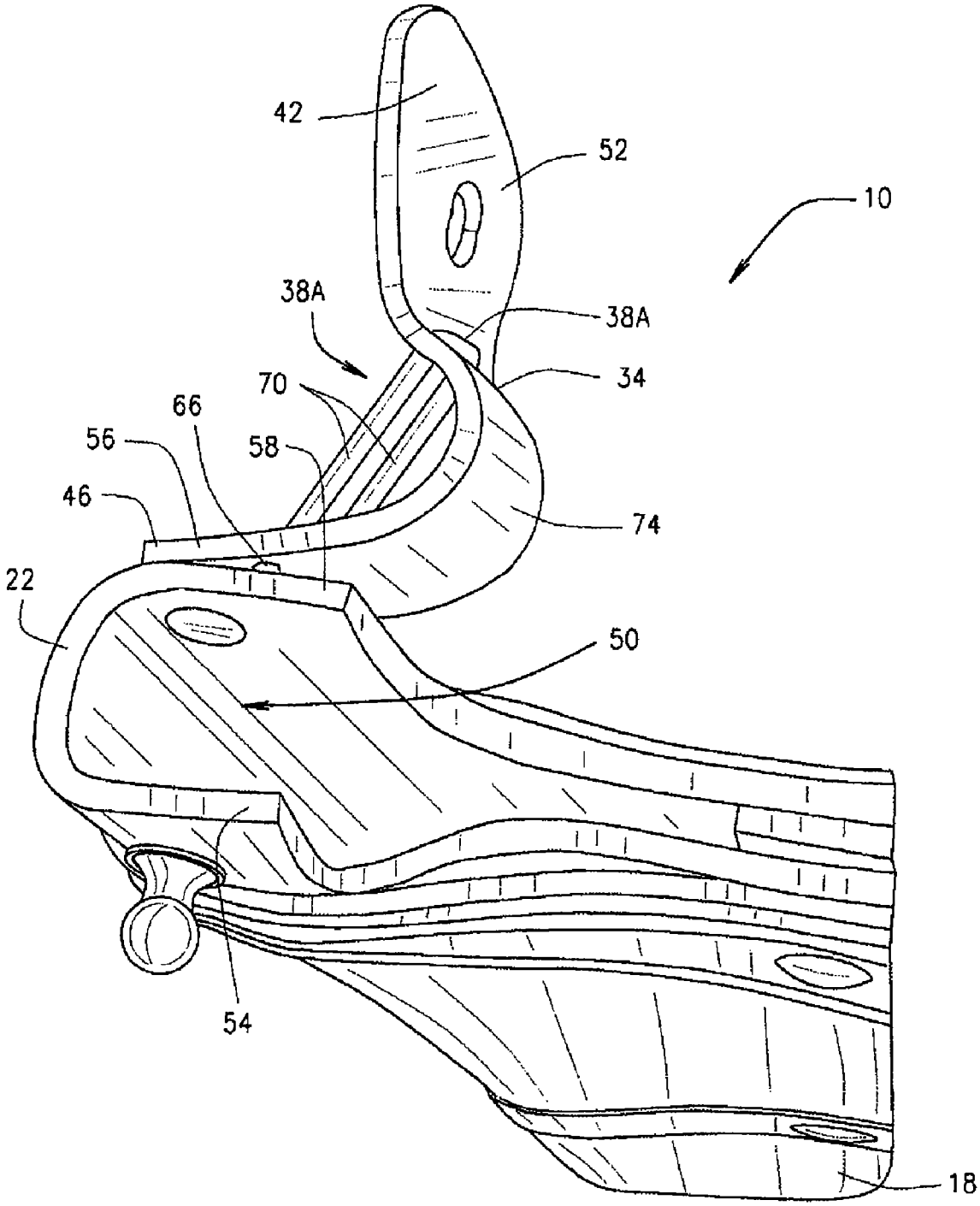
FIG. 3 is an isometric top view of the knife sheath shown in FIG. 1, illustrating the automatic swing-away retention strap in the open position such that a mouth of a sheath neck portion is opened.

Referring particularly to FIGS. 2 and 3, when in the open position, the distal end 42 is sufficiently adjacent the outer surface of the second side 58 of the sheath neck 22. As best illustrated in FIG. 3, when in the open position, retention strap 34 is curved in a second direction, i.e., a second curvature, that is opposite the first curved direction. Thus, the mouth 50 of neck 22 is open and the retention strap 34 effectively forms an 'S' with the neck 22. That is, if viewed from the top, when the retention strap 34 is in the open position, the shape of the neck top edge and the shape of retention strap top edge having the second curvature will effectively form a sine-like wave shape or substantially a 'S' shape. Accordingly, the retention strap 34 is placed and held clear from the open top of the sheath 10 and more particularly placed and held clear of a knife blade withdrawal path. Therefore, the knife 14 can be withdrawn or extracted from the sheath without contacting, cutting and/or damaging the retention strap 34.

Referring now to FIGS. 3 and 4, the biasing or tension device 38 can be any device, apparatus, component, part or mechanism suitable for providing force to pivot the distal end 42 about the proximal end 46 such that the distal end 42 swings outwardly away from the neck mouth 50 in a radial, whipping, unguided, non-channeled fashion. For example, in various embodiments, the biasing device 38 can be one of an elastic or elastomer cord 38A threaded through at least two first holes 62, e.g., two or four holes 62, in the distal end portion 52 of the retention strap 34. The cord 38A is also threaded through at least two second holes 66, e.g., two or four holes 66, in the proximal end portion 56 of the retention strap 34. A pair of pulling arm sections 70 of the elastic or elastomer cord 38A are stretched across an outer surface of the retention strap 34, conforming with the first curvature, when the retention strap 34 is in the fastened position, as illustrated in FIG. 4. When the distal end portion 52 is unfastened from the neck 22, the pulling arm sections 70 recover, i.e., returned to a non-stretched state, and linearly extend between the first and second holes 62 and 66, as illustrated in FIG. 3. More particularly, when the distal end portion 52 is unfastened from the neck 22, the pulling arm sections 70 provide force to pivot the distal end 42 about the proximal end 46 such that the distal end 42 swings outwardly away from the neck mouth 50 in a radial, whipping, unguided, non-channeled fashion. Additionally, when in the opened position, a central portion 74 of the retention strap 34 has the second curvature and is looped away from the pulling arm sections 70.

Although the elastic or elastomer cord 38A is shown in FIGS. 3 and 4 to be threaded through the first and second holes 62 and 66, as described above, the elastic or elastomer cord 38A can be connected to the distal and proximal end portions 52 and 56 in any other suitable manner. For example, in various embodiments, the elastic or elastomer cord 38A can be intertwined with, or sewn, glued, stapled or riveted to the distal and proximal end portions 52 and 56. Additionally, although the biasing device 38 is described above, and shown in FIGS. 3 and 4, as being one of an elastic or elastomer cord 38A, it is envisioned and within the scope of this disclosure, that in various embodiments the biasing device 38 can be one of an elastic or elastomer strip or strap connected to the distal and proximal end portions 52 and 56 in any suitable manner, such as those described above with regard to the elastic or elastomer cord 38A.

Figure 6:
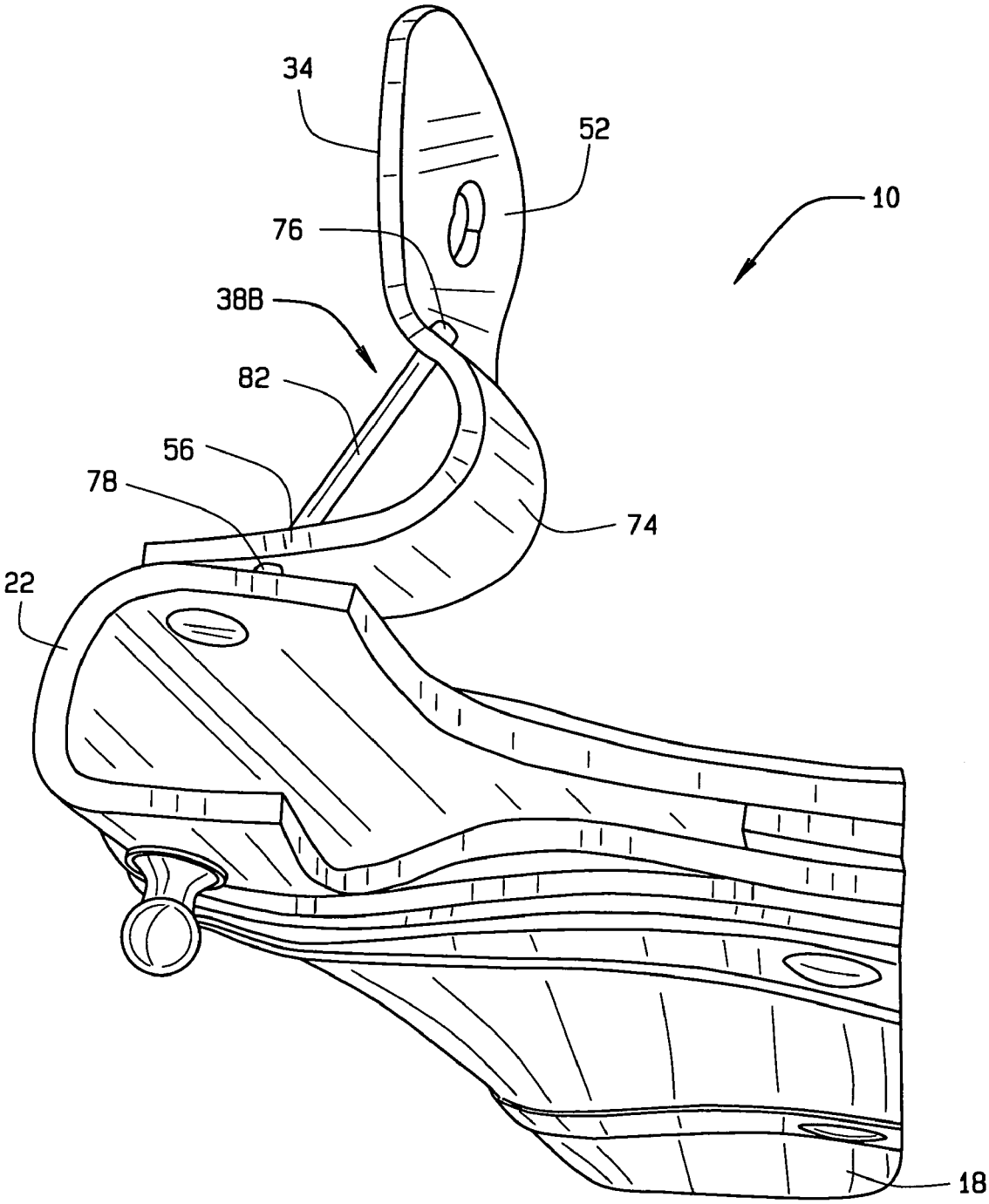
FIG. 6 is an isometric top view of the knife sheath shown in FIG. 1 illustrating the automatic swing-away retention strap including a biasing or tension device, in accordance with various embodiments.

Referring now to FIG. 6, in various other embodiments, the biasing device 38 can be an elastic or elastomer cord 38B threaded through at least one first hole 76 in the distal end portion 52 of the retention strap 34. The cord 38B is also threaded through at least one second hole 78 in the proximal end portion 56 of the retention strap 34. A pulling arm section 82 of the elastic or elastomer cord 38B are stretched across an outer surface of the retention strap 34, conforming with the first curvature, when the retention strap 34 is in the fastened position. When the distal end portion 52 is unfastened from the neck 22, the pulling arm section 82 recovers, i.e., returns to a non-stretched state, and linearly extends between the first and second holes 76 and 78. More particularly, when the distal end portion 52 is unfastened from the neck 22 the pulling arm section 82 provides force to pivot the distal end 42 about the proximal end 46 such that the distal end 42 swings outwardly away from the neck mouth 50 in a radial, whipping, unguided, non-channeled fashion. Additionally, when in the opened position, the central portion 74 of the retention strap 34 has the second curvature and is looped away from the pulling arm section 82.

Although the elastic or elastomer cord 38B is shown in FIG. 6 to be threaded through the first and second holes 76 and 78, as described above, the elastic or elastomer cord 38B can be connected to the distal and proximal end portions 52 and 56 in any other suitable manner. For example, in various embodiments, the elastic or elastomer cord 38B can be intertwined with, or sewn, glued, stapled or riveted to the distal and proximal end portions 52 and 56. Additionally, although the biasing device 38 is described above, and shown in FIG. 6, as being one of an elastic or elastomer cord 38B, it is envisioned and within the scope of this disclosure, that in various embodiments the biasing device 38 can be one of an elastic or elastomer strip or strap connected to the distal and proximal end portions 52 and 56 in any suitable manner, such as those described above with regard to the elastic or elastomer cord 38B. Further, as shown in FIG. 6, when the retention strap 34 is in the open position, a portion of the cord 38B between its two ends that are connected to the retention strap 34 is spaced from the retention strap 34.

Figure 7:
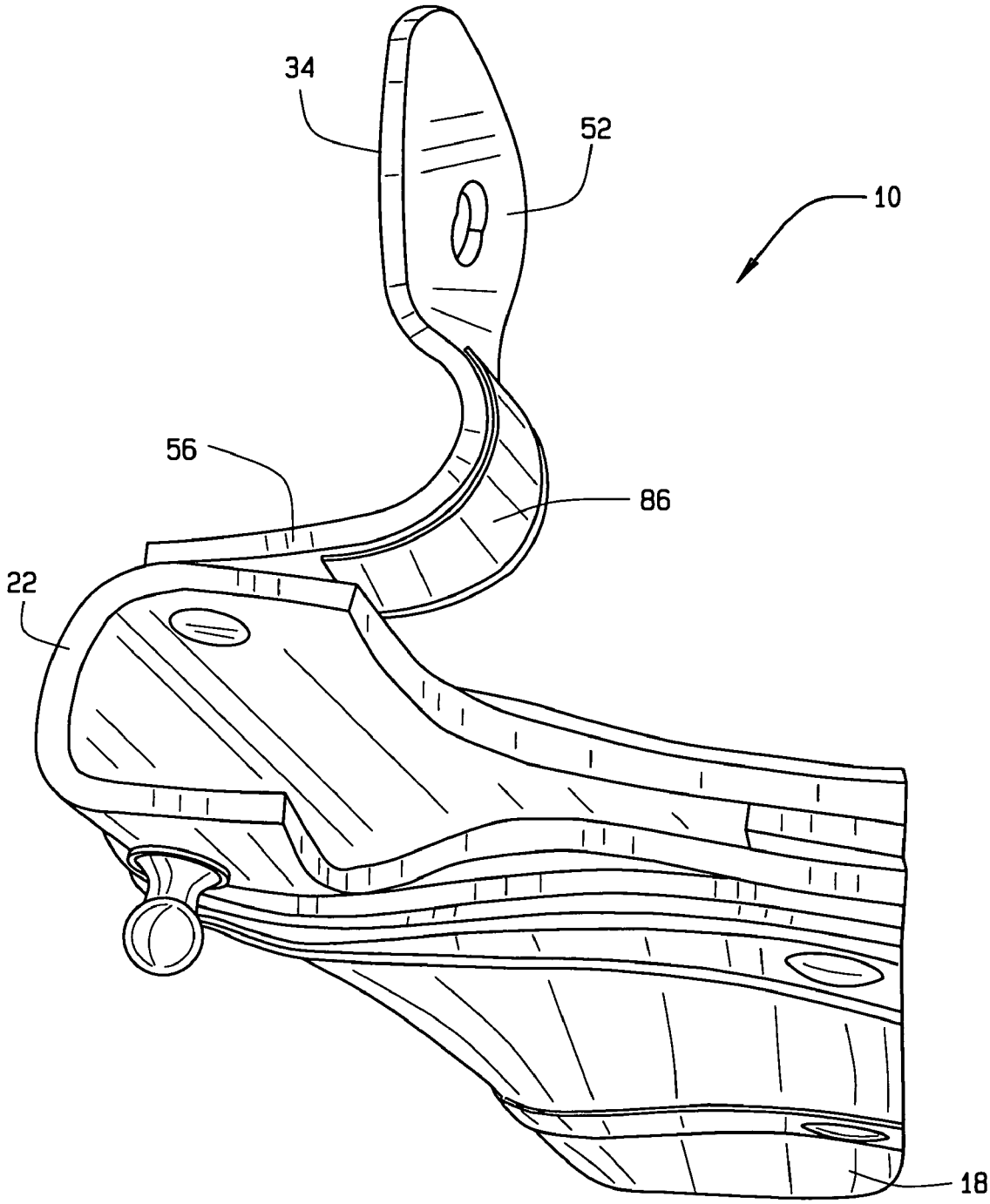
FIG. 7 is an isometric top view of the knife sheath shown in FIG. 1 illustrating the automatic swing-away retention strap including a biasing or tension device, in accordance with various other embodiments.

Referring now to FIG. 7, in yet other various embodiments, the biasing device 38 can be a spring-like, resilient preformed strip or plate 86 attached to the retention strap 34. The spring-like, resilient preformed strip 86 is preformed to have a substantially 'U' shape when the spring-like, resilient preformed strip 86 is in a non-flexed state. Additionally, the spring-like, resilient preformed strip 86 is attached to the retention strap 34 such that the retention strap 34 is biased to the open position. When the retention strap 34 is placed in the fastened position, the spring-like, resilient preformed strip 86 is flexed to form the first curvature. Conversely, when the retention strap 34 is unfastened, the spring-like, resilient preformed strip 86 automatically returns to the non-flexed shape forming the second curvature and places and holds the retention strap 34 in the open position. More particularly, when the distal end portion 52 is unfastened from the neck 22 the spring-like, resilient preformed strip 86 provides force to pivot the distal end 42 about the proximal end 46 such that the distal end 42 swings outwardly away from the neck mouth 50 in a radial, whipping, unguided, non-channeled fashion.

The spring-like, resilient preformed strip or plate 86 can be attached to the retention strap 34 in any suitable manner. For example, the spring-like, resilient preformed strip 86 can be glued, sewn, stapled, riveted or screwed to the retention strap 34. Furthermore, the spring-like, resilient preformed strip or plate 86 can be any suitable biasing device, part or component that is preformed to bias the retention strap 34 to the open position, yet flexible and resilient such that the spring-like, resilient preformed strip 86 can be easily flexed to fastened the distal end portion 52 to the neck 22, as described above. For example, in various embodiments, the spring-like, resilient preformed strip 86 can be a tempered, spring metal strip or plate attached to the retention strap 34. Or, in various other embodiments, the spring-like, resilient preformed strip 86 can be one of a molded polymer or plastic strip or plate attached to the retention strap 34. Or, in yet other various embodiments, the spring-like, resilient preformed strip 86 can be one of a molded rubber strip or plate attached to the retention strap 34.

Figure 8:
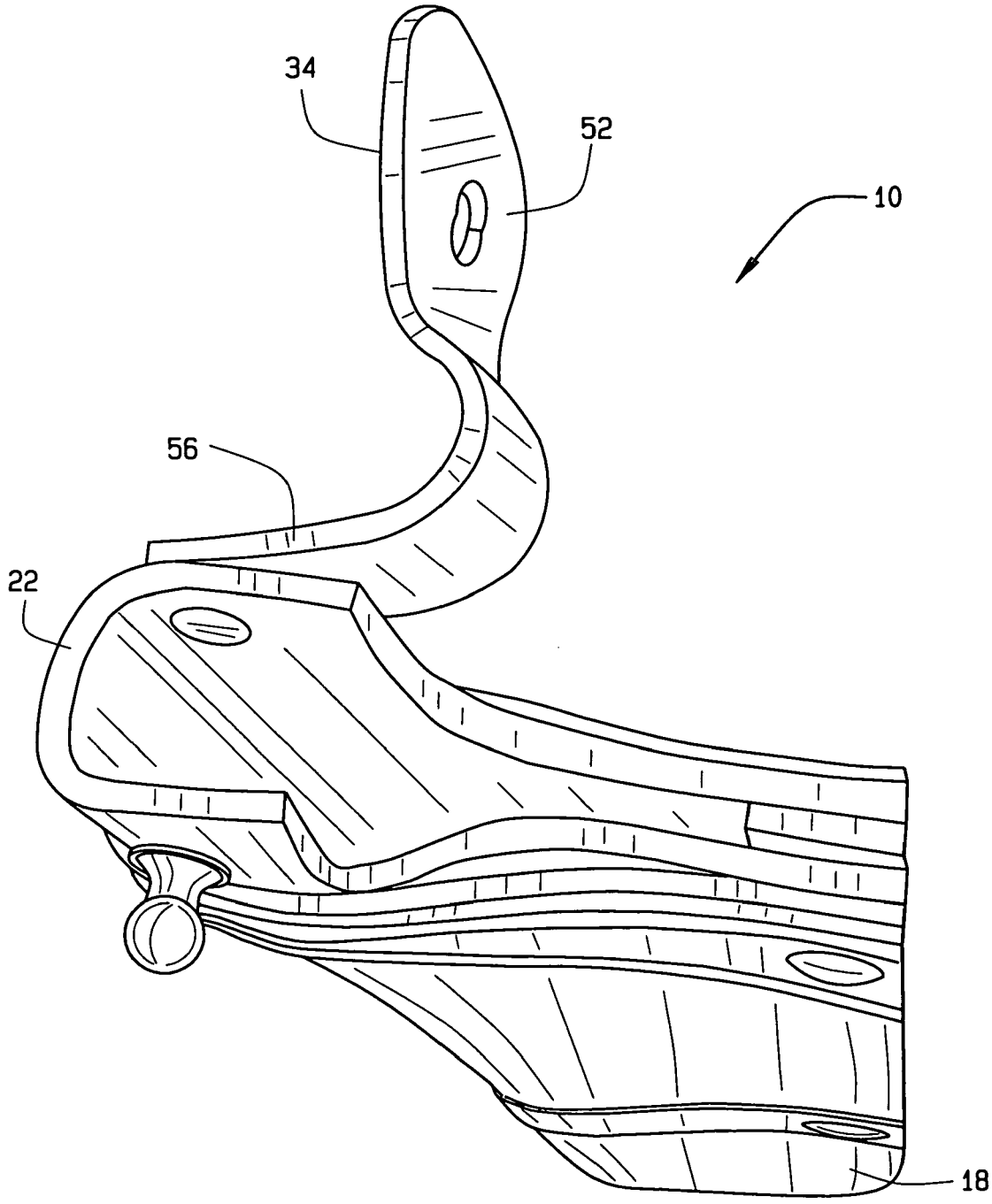
FIG. 8 is an isometric top view of the knife sheath shown in FIG. 1 illustrating the automatic swing-away retention strap including a biasing or tension device, in accordance with yet various other embodiments.

Referring now to FIG. 8, in still yet other various embodiments, the retention strap 34 can be a preformed molded strap molded to have the substantially 'U' shape when in a non-flexed state. Therefore, the biasing device 38 comprises the preformed molded retention strap 34 such that the preformed molded shape of the molded retention strap 34 biases the retention strap 34 to the open position, as described above. For example, in various embodiments, the preformed molded retention strap 34 can comprise a molded leather retention strap, molded polymer retention strap, or any other suitably resilient and flexible molded retention strap 34.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A knife sheath comprising:

a body for housing a blade of a knife;

a neck extending from an open top of the body for partially encompassing a portion of a handle of the knife;

a retention strap including a distal end detachably connectable to a first side of the neck and a proximal end fixedly attached to an opposing second side of the neck; and at least one biasing device attached to the retention strap and structured and operable to pivot the distal end about the proximal end to automatically swing the distal end outwardly and away from the neck, in an unguided manner:

from a fastened position having the distal end detachably fastened to an outer surface of the first side of the sheath neck such that the retention strap is curved in a first direction that closes a mouth of the neck and effectively forms an 'O' with the neck to wrap around the portion of the handle of the knife retained within the sheath, to an open position having a distal end sufficiently adjacent an outer surface of the opposing second side of the sheath neck such that the retention strap is curved in a second direction that is opposite the first curved direction to open the mouth of the neck and effectively form an 'S' with the neck to position the retention strap clear from a knife blade withdrawal path to allow the knife to be removed from the sheath without contacting the retention strap; and wherein the at least one biasing device comprises one of an elastic cord and an elastomer cord threaded through at least one first hole in a distal end portion of the retention strap and threaded through at least one second hole at a proximal end portion of the retention strap such that a pulling arm section of the cord is stretched across an outer surface of the retention strap, conforming with the first curvature, when the retention strap is in the fastened position, and is recovered to linearly extend between the at least one first and second holes, with a central portion of the retention strap having the second curvature and looped away from the pulling arm section, when the retention strap is in the open position.

2. A knife sheath comprising a body for housing a blade of a knife, and an automatic swing-away retention strap including at least one biasing device structured and operable to automatically pivot a detachable distal end of the retention strap about a fixed proximal end of the retention strap to swing the distal end from a fastened position wherein the retention strap has a first curvature for wrapping around a portion of a handle of the knife when the blade is retained within the body, to an open position wherein the retention strap has a second curvature that is opposite the first curvature to allow withdrawal of the blade from the body without contacting the retention strap, wherein the at least one biasing device comprises:

at least one elastomer cord having a first end connected to a distal end portion of the retention strap and having a second end connected to a proximal end portion of the retention strap, wherein when the retention strap is in the open position, a portion of the cord between the first and second ends is spaced from the retention strap.

3. A knife sheath comprising an automatic swing-away retention strap including at least one biasing device structured and operable to automatically pivot a detachable distal end of the retention strap about a fixed proximal end of the retention strap to swing the distal end in an unguided manner from a fastened position having a first curvature adapted to wrap around a portion of a handle of a knife retained within the sheath, to an open position having a second curvature opposite the first curvature and adapted to position the retention strap clear from a knife blade withdrawal path to allow the knife to be removed from the sheath without contacting the retention strap, wherein the at least one biasing device comprises:

at least one elastomer cord having a first end connected to a distal end portion of the retention strap and having a second end connected to a proximal end portion of the retention strap, wherein when the retention strap is in the open position, a portion of the cord between the first and second ends is spaced from the retention strap.

* * * * *

UNITED STATES PATENT AND TRADEMARK OFFICE

CERTIFICATE OF CORRECTION

PATENT NO. : 7,587,827 B2
APPLICATION NO. : 11/481715
DATED : September 15, 2009
INVENTOR(S) : Paul Alan Scheiter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 313 days.

Signed and Sealed this

Twenty-first Day of September, 2010

David J. Kappos

David J. Kappos
*Director of the United States Patent and Trademark Office*